United States Patent [19]

Sakamaki et al.

[11] Patent Number: 5,044,910

[45] Date of Patent: Sep. 3, 1991

[54] VANE PUMP WITH ROTATABLE DRIVE MEANS FOR VANES

[75] Inventors: Hiroshi Sakamaki; Yukio Horikoshi; Takeshi Jinnouchi; Kenji Tanzawa, all of Sakado, Japan

[73] Assignee: Eagle Industry Co., Ltd., Tokyo, Japan

[21] Appl. No.: 590,568

[22] Filed: Sep. 28, 1990

Related U.S. Application Data

[60] Continuation of Ser. No. 394,620, Aug. 16, 1989, abandoned, which is a division of Ser. No. 197,548, May 23, 1988, Pat. No. 4,958,995, which is a continuation-in-part of Ser. No. 75,006, Jul. 17, 1987, abandoned, and a continuation-in-part of Ser. No. 110,919, Oct. 21, 1987, abandoned, and a continuation-in-part of Ser. No. 113,568, Oct. 26, 1987, abandoned, and a continuation-in-part of Ser. No. 115,677, Oct. 30, 1987, abandoned.

[30] Foreign Application Priority Data

| | | | |
|---|---|---|---|
| Jul. 22, 1986 | [JP] | Japan | 61-111490[U] |
| Jul. 22, 1986 | [JP] | Japan | 61-170903 |
| Oct. 23, 1986 | [JP] | Japan | 61-161609[U] |
| Oct. 23, 1986 | [JP] | Japan | 61-161610[U] |
| Nov. 4, 1986 | [JP] | Japan | 61-168145[U] |
| Nov. 4, 1986 | [JP] | Japan | 61-168147[U] |
| Nov. 14, 1986 | [JP] | Japan | 61-269960[U] |
| Nov. 14, 1986 | [JP] | Japan | 61-269961 |
| Nov. 17, 1986 | [JP] | Japan | 61-271934 |
| Nov. 21, 1986 | [JP] | Japan | 61-178287[U] |
| Nov. 21, 1986 | [JP] | Japan | 61-178288[U] |
| Nov. 21, 1986 | [JP] | Japan | 61-276689 |
| Nov. 21, 1986 | [JP] | Japan | 61-276690 |
| Dec. 3, 1986 | [JP] | Japan | 61-185571[U] |

[51] Int. Cl.[5] ..... F01C 1/344

[52] U.S. Cl. ..... 418/253; 418/261

[58] Field of Search ..... 418/253, 257, 260, 261, 418/262, 264, 265, 256

[56] References Cited

U.S. PATENT DOCUMENTS

| | | | |
|---|---|---|---|
| 967,108 | 8/1910 | Dargin | 418/265 |
| 1,444,269 | 2/1923 | Piatt | 418/257 |
| 4,212,603 | 7/1980 | Smolinski | 418/265 |

FOREIGN PATENT DOCUMENTS

| | | | |
|---|---|---|---|
| 492322 | 2/1930 | Fed. Rep. of Germany | 418/264 |

*Primary Examiner*—John J. Vrablik

*Attorney, Agent, or Firm*—Jordan and Hamburg

[57] ABSTRACT

A rotary vane machine has rotatable cams between annular rings which are rotatable in a housing and vanes which are radially slidable in a rotor, the cams rotatably drive the annular rings and prevent the vanes from contacting the inner peripheral surface of the housing.

10 Claims, 9 Drawing Sheets

VANE PUMP WITH ROTATABLE DRIVE MEANS FOR VANES

RELATED APPLICATIONS

This is a continuation application of U.S. Ser. No. 394,620 filed Aug. 16, 1989, abandoned, said Ser. No. 394,620 being a divisional application of U.S. Ser. No. 197,548 filed May 23, 1988, now U.S. Pat. No. 4,958,995 said Ser. No. 197,548 being a continuation-in-part application of U.S. Ser. No. 075,006 filed July 17, 1987, abandoned; U.S. Ser. No. 110,919 filed Oct. 21, 1987, abandoned; U.S. Ser. No. 113,568 filed Oct. 26, 1987, abandoned; and U.S. Ser. No. 115,677 filed Oct. 30, 1987, abandoned.

BACKGROUND OF THE INVENTION

The present invention relates to a vane pump which is one of rotary pumps used for various kinds of apparatuses such as a supercharger of an engine, a compressor of a freezing cycle, and the like.

A vane pump schematically shown in FIG. 11 has been heretofore widely known.

In FIG. 11, reference numeral 101 designates a housing; 102, a rotor inserted eccentrically into an inner peripheral space of the housing 101 and rotatably supported by a rotational shaft 103; 105*a*, 105*b* and 105*c*, plate-like vanes disposed radially retractably from vane grooves 104*a*, 104*b* and 104*c* equally spaced apart so as to peripherally divide the outer peripheral side of the rotor 102 into three sections. When the rotor 102 is rotated in the direction as indicated by the arrow X by the rotational shaft 103, the vanes 105*a*, 105*b* and 105*c* are moved out in the direction of the outside diameter by the centrifugal force, and the end edges thereof rotate while slidably contacting the inner peripheral surface of the housing 101. Since the rotor 102 is eccentric with respect to the housing 101 as previously mentioned, as such rotation occurs, volumes of working spaces 106*a*, 106*b* and 106*c* defined by the housing 101, the rotor 102 and the vanes 105*a*, 105*b* and 105*c* are repeatedly enlarged and contracted to allow a fluid taken in from an intake port 107 to be discharged out of an outlet port 108.

However, the above-described conventional vane pump has problems that since the vanes slidably move along the inner peripheral surface of the housing at high speeds, the efficiency of the volume caused by the great power loss due to the sliding resistance and by the generation of high sliding heat unavoidably deteriorates; the vanes materially become worn; and the vanes are expanded due to the generation of sliding heat to produce a galling with the inner side surfaces of both end walls of the housing, and the like.

In view of these problems as noted above, it is an object of the present invention to enhance the efficiency of such a pump and enhance the durability thereof.

SUMMARY OF THE INVENTION

The present invention provides a vane pump comprising a rotor rotatably supported in eccentric fashion in an inner peripheral space of a housing, and plate-like vanes disposed capable of being projected and retracted into a plurality of vane grooves in the form of a depression in the rotor, wherein repeated variations in volumes of working spaces between the vanes are utilized to suck a fluid from one side and discharge it toward the other, characterized in that retainer plates coaxial with the inner peripheral spaces are rotatably fitted internally of the end wall of the housing, and the vanes and retainer plates are connected by cams to define the protrusion of the vanes from the vane grooves.

According to the present invention, the protrusion of the vanes from the vane grooves is not defined by the contact with the inner peripheral surface of the housing but it is defined so that the end edges of the vanes depict a given locus by engagement of the retainer plates fitted in the housing with the vanes through the cams. The vanes can be rotated in a state not in contact with the inner surface of the housing. Therefore, the present invention has excellent effects in that the lowering of the rotational efficiency and the wear of the vanes due to the sliding resistance can be prevented, and the occurrence of inconvenience such as the lowering of the volume efficiency due to the increase in heat generation caused by sliding can also be prevented.

While the present invention has been briefly outlined, the above and other objects and new features of the present invention will be fully understood from the reading of the ensuing detailed description in conjunction with embodiments shown in the accompanying drawings. It is to be noted that the drawings are exclusively used to show certain embodiments for the understanding of the present invention and are not intended to limit the scope of this invention.

DESCRIPTION OF THE PREFERRED EMBODIMENTS

A fundamental exemplification of a vane pump according to the present invention will now be described with reference to FIGS. 1 to 3.

Figure 1:
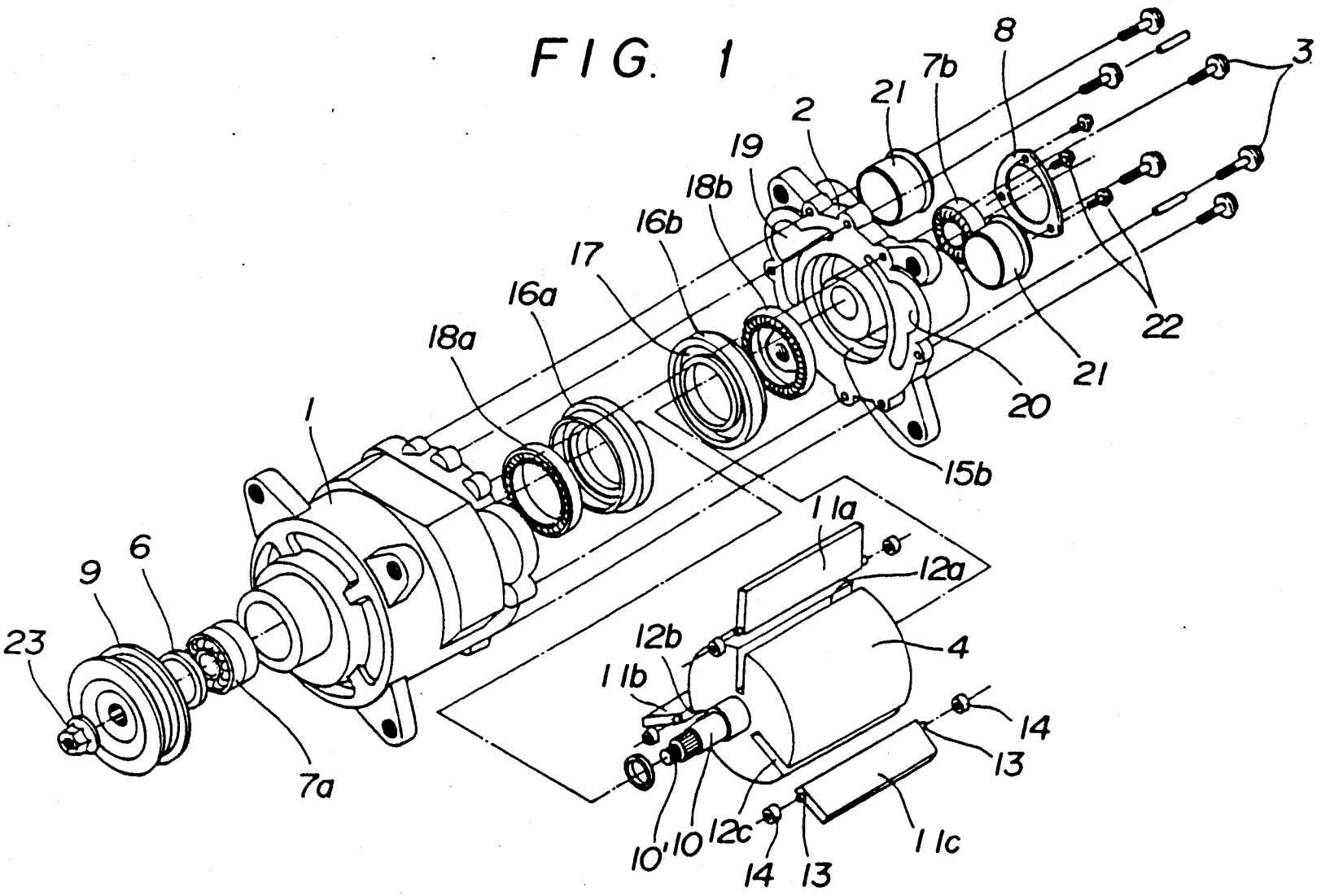
FIG. 1 is an exploded perspective view of a vane pump according to a fundamental embodiment of the present invention.
Figure 2:
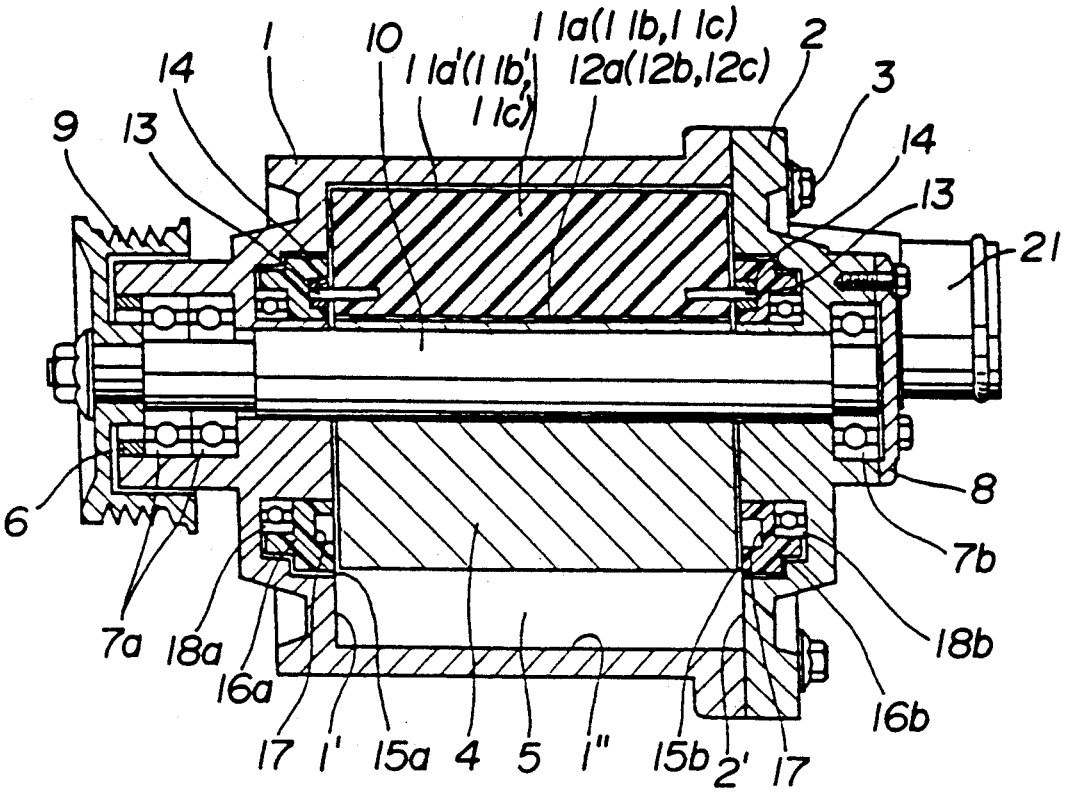
FIG. 2 is a sectional view showing the pump of FIG. 1 assembled.
Figure 3:
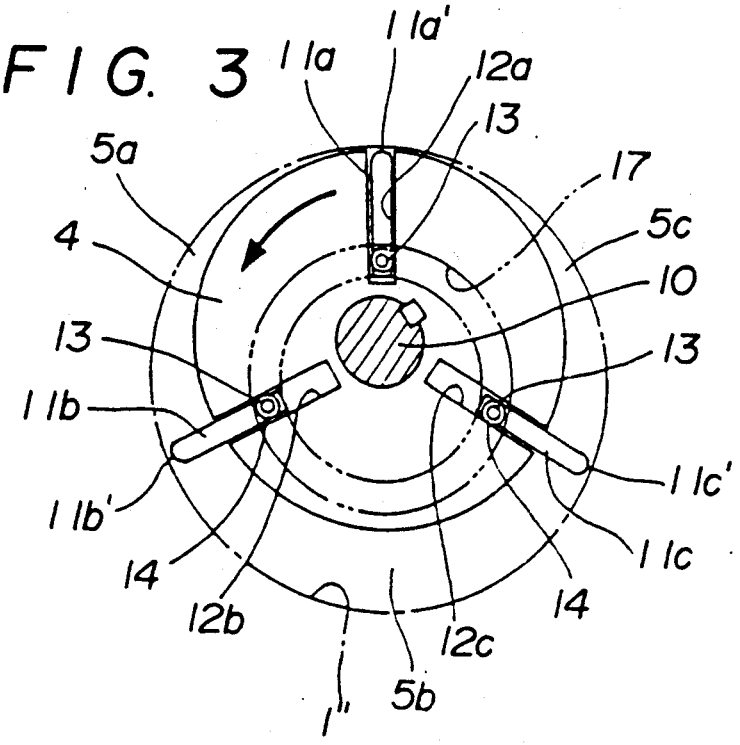
FIG. 3 is a side view of a rotor of the same pump; of FIG. 1

In FIGS. 1 and 2, a front housing 1 and a rear housing 2, both of which housings are made of non-ferrous metal such as aluminum, which is light in weight and is small in the coefficient of thermal expansion, are secured integral with each other by means of bolts 3. A rotor 4 made of iron eccentrically inserted into an inner peripheral space 5 of the housing is extended through both the housings 1 and 2 through a ball bearing 7*a* held by a fixed ring 6 in anti-slipout fashion in an axial shoulder of the front housing 1 and a ball bearing 7b held by a bearing cover 8 in anti-slipout fashion in an axial shoulder of the rear housing 2 and is rotatably mounted on a rotational shaft 10 to which a drive force is transmitted from a pulley 9. Plate-like vanes 11a, 11b and 11c principally made of a carbon material having an excellent slidability are disposed to be radially projected and retracted in vane grooves 12a, 12b and 12c, respectively, which are formed in the form of depressions equally spaced apart so as to peripherally divide the outer peripheral side of the rotor 4 into three sections, on the rotor 4. On opposite ends of each of the vanes 11a, 11b and 11c corresponding to axial opposite sides of the rotor 4 are projected steel pins 13 and 13, respectively, and a sleeve bearing 14 made of resin having excellent slidability and abrasion resistance is slipped over each of pins 13. In annular recesses 15a and 15b formed in inner surfaces 1' and 2' of end walls where the front housing 1 and the rear housing 2 are opposed to each other coaxial with the inner peripheral space 5 of the housing (coaxial with the inner peripheral surface 1'' of the front housing 1), retainer rings 16a and 16b made of non-ferrous metal such as aluminum and each having an annular race 17 are rotatably fitted through ball bearings 18a and 18b, respectively. The pins 13 and 13 projected on the respective vanes 11a, 11b and 11c peripherally slidably engage the annular races 17 and 17 of the retainer rings 16a and 16b through the respective sleeve bearings 14. This engagement defines the radial movement of the vanes 11a, 11b and 11c during rotation so as to maintain a state in which there is formed a slight clearance between the end edges 11a', 11b' and 11c' (see FIG. 3) thereof and the inner peripheral surface 1'' of the front housing 1. An intake port 19 for guiding a fluid into the inner peripheral space 5 of the housing from the exterior of the pump and an outlet port 20 for guiding a fluid to the exterior from the inner peripheral space 5 of the housing are formed in the rear housing 2. Reference numerals 21, 21 designate tubes mounted on the intake port 19 and outlet port 20, respectively; 22 a bolt used to secure the bearing cover 8 to the rear housing 2; and 23, a nut in engagement with an external thread 10' of the end of the rotational shaft 10 in order to secure the pulley 9 to the rotational shaft 10.

The operation of the above-described vane pump will be described hereinafter. When the rotational shaft 10 and rotor 4 are rotated by the drive force from the pulley 9, the vanes 11a, 11b and 11c also rotate, and the pins 13 and 13 projected on the vanes 11a, 11b and 11c, respectively, and the sleeve bearings 14 and 14 slipped over the pins 13 and 13 rotate along the annular races 17 and 17. Since as shown in FIG. 3, the inner peripheral surface 1'' of the housing and the annular race 17 are in coaxial relation and the annular race 17 and the rotor 4 are in eccentric relation, the vanes 11a, 11b and 11c are radially slidably moved in the vane grooves 12a, 12b and 12c of the rotor 4 to be projected and retracted repeatedly with the result that the volumes of the working spaces 5a, 5b and 5c defined by both the housings 1, 2, the rotor 4 and the vanes 11a, 11b and 11c repeatedly increase and decrease. That is, in FIG. 3, the working space 5a, with the rotation, increases its volume to suck the fluid from the intake port 19 (not shown; see FIG. 1) opening to portion 5a; the working space 5c, with the rotation, decreases its volume to discharge the fluid into the outlet port 20 (not shown; see FIG. 1) opening to portion 5c; and the working space 5b transfers the thus sucked fluid toward the outlet port 20. In the above-described operation, the end edges 11a', 11b' and 11c' of the vanes 11a, 11b and 11c are not in sliding contact with the inner peripheral surface 1'' of the front housing, as previously mentioned, and therefore, abrasion or high heat hardly occurs. In addition, the sleeve bearing 14 slipped over the pin 13 is slidably rotated while being pressed against the outside diameter side by the centrifugal force within the annular race 17 of the retainer rings 16a and 16b while the retainer rings 16a and 16b follow the sleeve bearing 14 for rotation because the former are in the state to be rotatable by the ball bearings 18a and 18b, respectively. The relative sliding speed between the sleeve bearing 14 and the annular race 17 is low whereby the abrasions of annular race 17, retainer rings 16a and 16b, the sleeve bearing 14 and the like can be minimized.

It is believed that the fundamental mode of the present invention is now fully understood from the above-described description. The pump of the first embodiment shown in FIGS. 1 to 3 constitutes, in a sense, the core of the variations described below.

An exemplication of a vane pump according to the present invention will be described hereinafter with reference to the embodiments shown in FIGS. 4 to 10.

Figure 4:
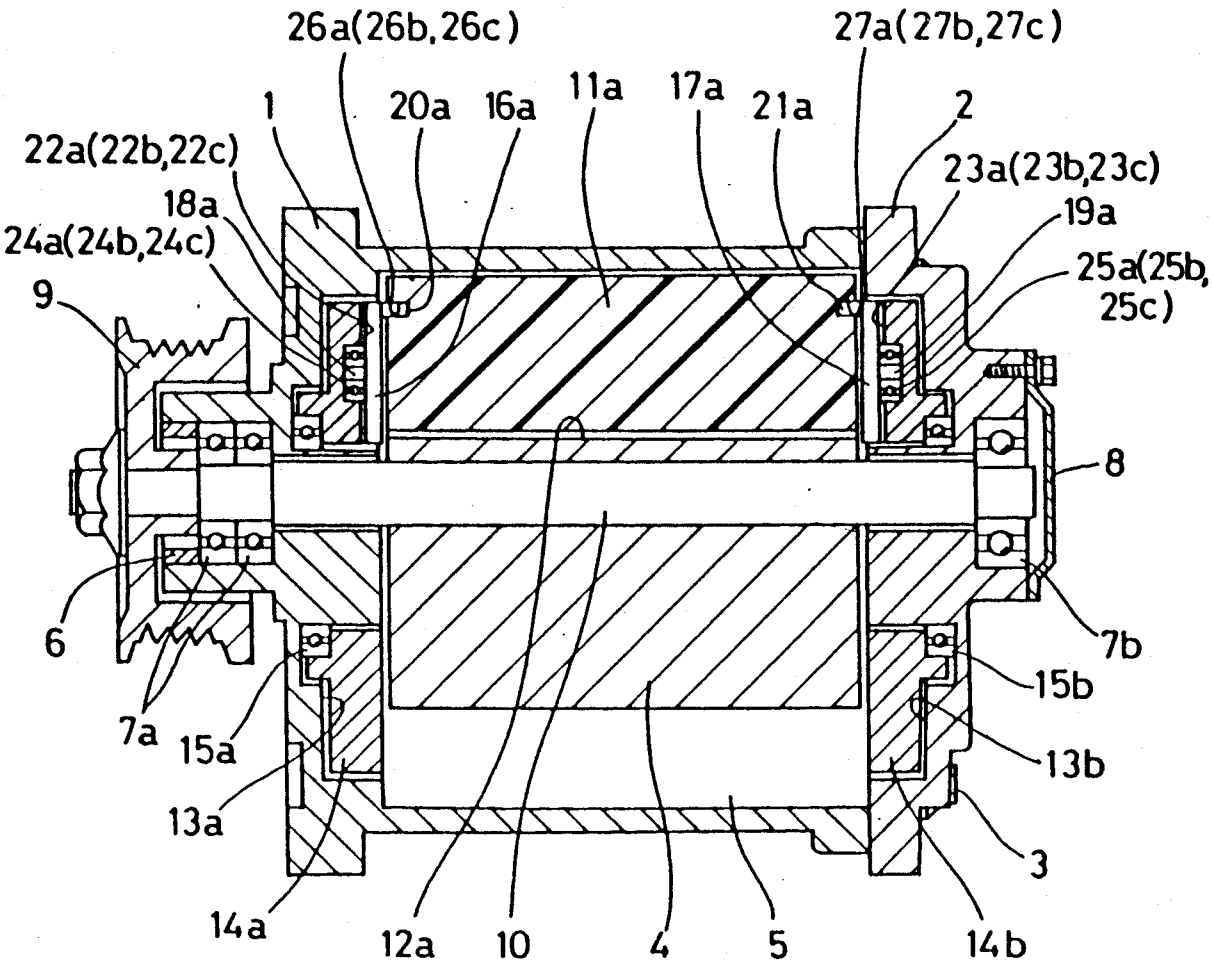
FIG. 4 is a sectional view of a vane pump according to another exemplification of the present invention.
Figure 5:
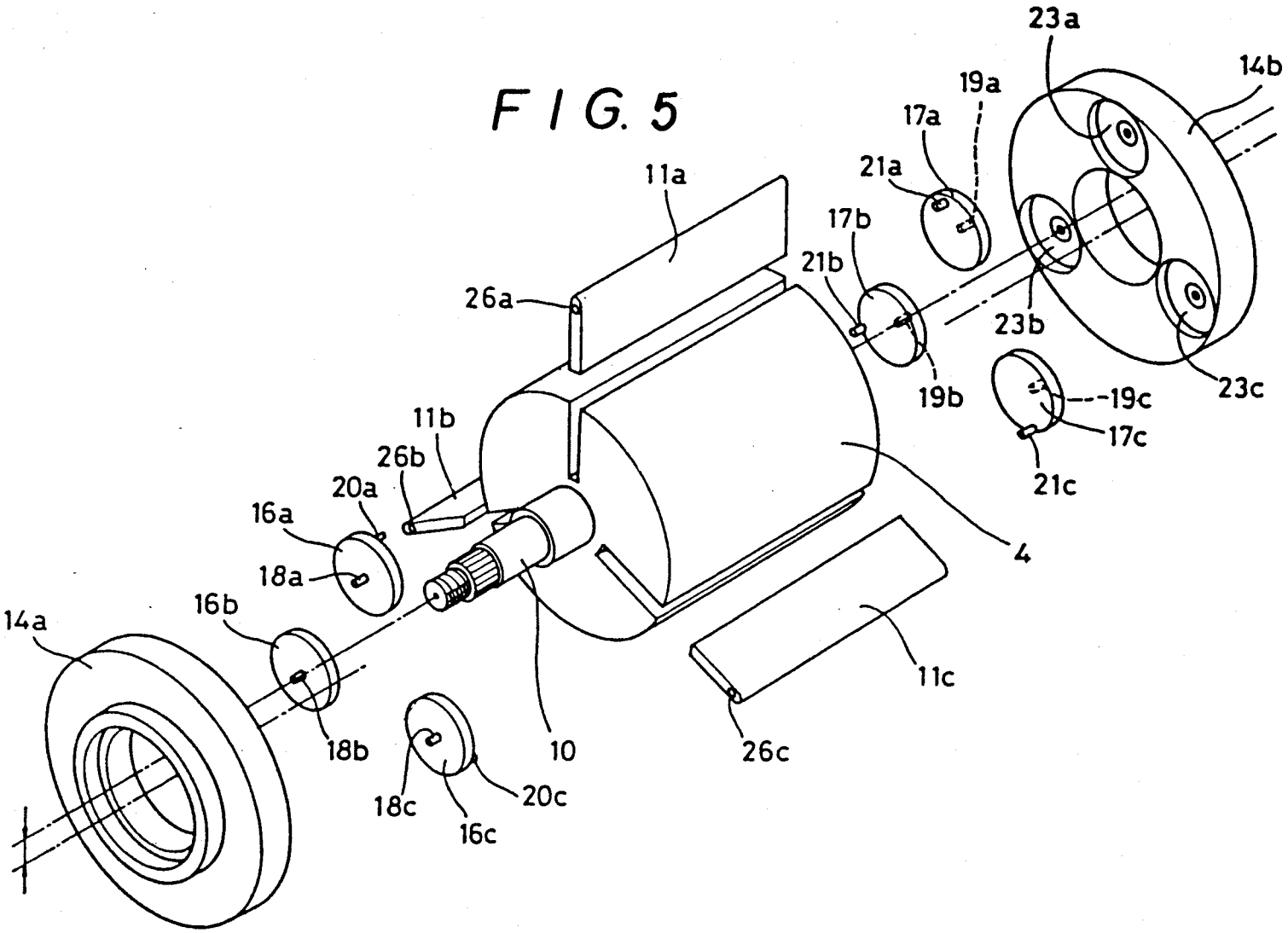
FIG. 5 is an exploded perspective view of an essential part of the FIG. 4 vane pump.
Figure 6:
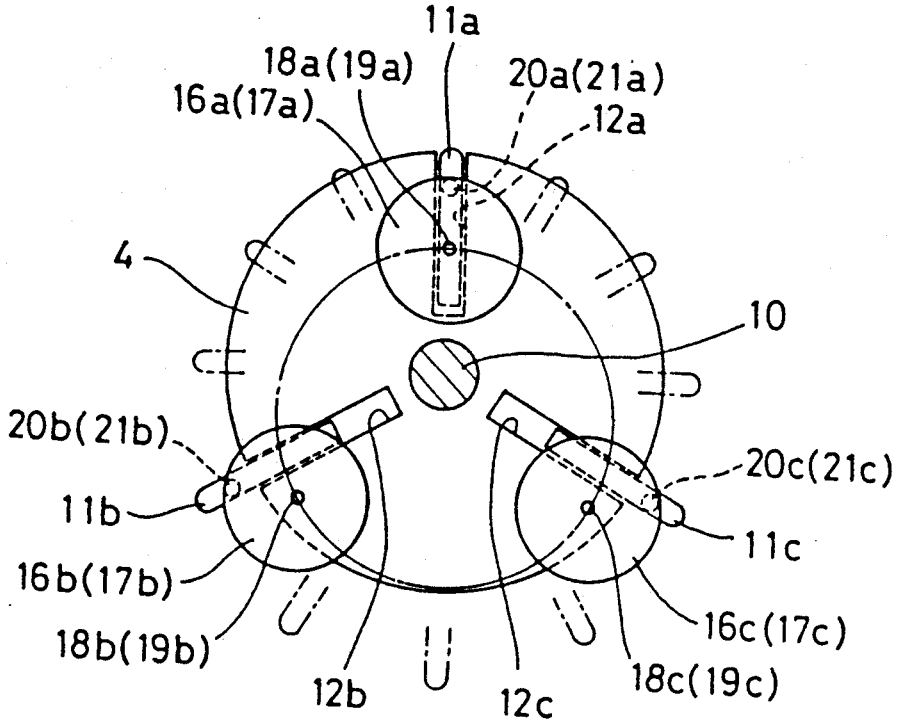
FIG. 6 is an explanatory view of the operation of the FIG. 4 vane pump.
Figure 7:
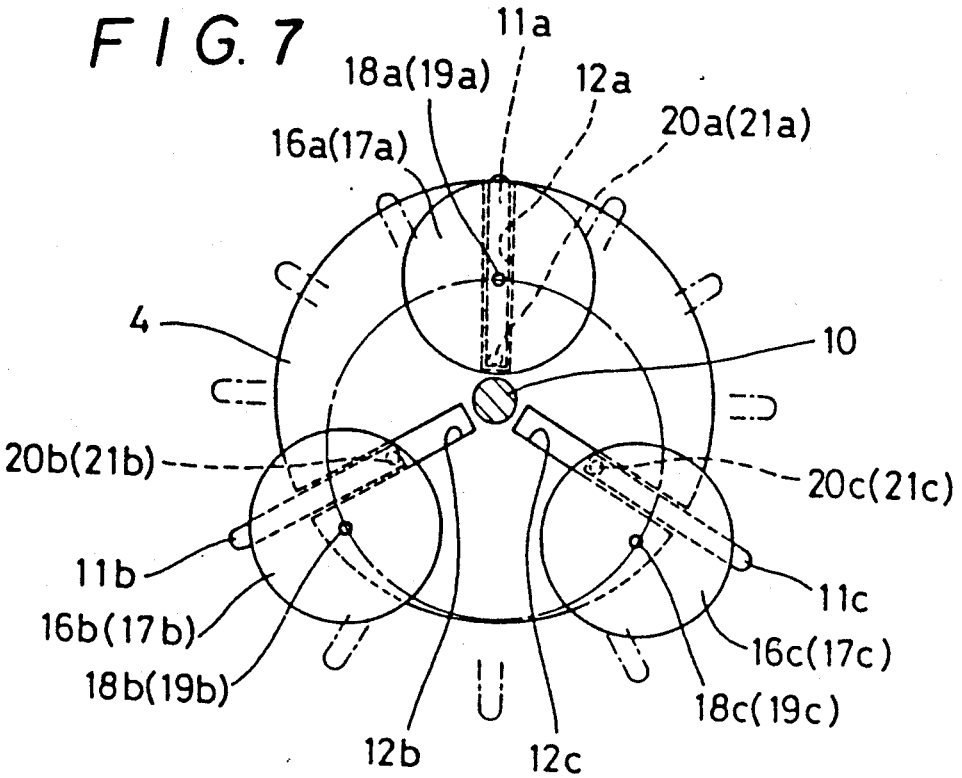
FIG. 7 is an explanatory view of the operation of a vane pump according to a further embodiment of the present invention.

In FIGS. 4 to 6 showing a first embodiment, a front housing 1 and a rear housing 2, which both housings are made of non-ferrous metal such as aluminum which is light in weight and is small in the coefficient of thermal expansion, are secured integral with each other by means of bolts. A rotor 4 made of iron eccentrically inserted into an inner peripheral space 5 of the housing is extended through both the housings 1 and 2 through a ball bearing 7a held by a fixed ring 6 in anti-slipout fashion in an axial shoulder of the front housing 1 and a ball bearing 7b held by a bearing cover 8 in anti-slipout fashion in an axial shoulder of the rear housing 2 and is rotatably mounted on a rotational shaft 10 to which a drive force is transmitted from a pulley 9. Plate-like vanes 11a, 11b and 11c principally made of a carbon material having an excellent slidability are disposed to be radially projected and retracted in vane grooves 12a, 12b and 12c, respectively, which are formed in the form of depressions equally spaced apart so as to peripherally divide the outer peripheral side of the rotor 4 into three sections, on the rotor 4. In annular recesses 13a and 13b formed in inner surfaces of end walls where the front housing 1 and rear housing 2 are opposed to each other coaxial with the inner peripheral space 5 of the housing (coaxial with an inner peripheral surface of the front housing 1), retainer plates 14a and 14b made of non-ferrous metal such as aluminum are rotatably fitted through ball bearings 15a and 15b, respectively. The vanes 11a, 11b and 11c are brought into engagement with the retainer plates 14a and 14b through cams 16a, 16b, 16c, 17a, 17b and 17c. The cams 16a, 16b, 16c, 17a, 17b and 17c fitted in recesses 22a, 22b, 22c, 23a, 23b and 23c equally spaced apart into three sections in the inner surface of the retainer plates 14a and 14b are rotatably provided on the retainer plates 14a and 14b through ball bearings 24a, 24b, 24c, 25a, 25b and 25c, with first pins 18a, 18b, 18c, 19a, 19b and 19c in engagement with the retainer plates 14a and 14b projected around one surface (outer surface) of a circular rotary plate, and are rotatably engaged with engaging recesses 26a, 26b, 26c, 27a, 27b and 27c in which second pins 20a, 20b, 20c, 21a, 21b and 21c are formed on the side ends of the vanes 11a, 11b and 11c, with second pins 20a, 20b, 20c, 21a, 21b and 21c in engagement with the vanes 11a, 11b and 11c projected in the vicinity of the peripheral edge of the other surface (inner surface) of the rotary plate. The engaging recesses 26a, 26b, 26c, 27a, 27b and 27c are provided close to the outer ends of the side ends of the vanes 11a, 11b and 11c. As shown in FIG. 7, at the top position in which the vane 11a is retracted most deeply within the vane groove 12a, the pins 18a, 19a, 20a and 21a of the cams 16a and 17a are laid on the vane 11a, and the second pins 20a and 21a are positioned close to the other ends of the first pins 18a and 19a.

The operation of the vane pump will be described hereinafter. When the rotational shaft 10 and the rotor 4 are rotated by the drive force from the pulley 9, the vanes 11a, 11b and 11c also rotate, and the torque is transmitted from the vanes 11a, 11b and 11c to the retainer plates 14a and 14b through the cams 16a, 16b, 16c, 17a, 17b and 17c. The retainer plates 14a and 14b rotate coaxially with respect to the peripheral surface of the housing, as a consequence of which the cams 16a, 16b, 16c, 17a, 17b and 17c fitted in the recesses 22a, 22b, 22c, 23a, 23b and 23c of the retainer plates 14a and 14b also rotate (revolve) coaxially with respect to the inner peripheral surface of the housing. Since the rotor 4 is rotatably mounted in eccentric relation with respect to the inner peripheral surface of the housing, as previously mentioned, the vane 11a and the cams 16a and 17a laid one above another at the top position are deviated with the rotation (but they are again laid one above another at the bottom position which is symmetrical with the top position through 180 degrees) at which the vane 11a is moved out of the vane grooves 12a farthest. With this arrangement, the vanes 11a, 11b and 11c connected to the retainer plates 14a and 14b through the cams 16a, 16b, 16c, 17a, 17b and 17c are radially slidably moved and repeatedly projected and retracted into the vane grooves 12a, 12b and 12c of the rotor 4 with the result that volumes of the working space defined by the housings 1, 2, the rotor 4 and the vanes 11a, 11b and 11c are repeatedly increased and decreased to transfer the fluid from the intake port shown to the outlet port. In the above-described operation, the protrusion of the vanes 11a, 11b and 11c from the vane grooves 12a, 12b and 12c is defined, and the vanes are rotated not in contact with the inner peripheral surface of the housing, thereby eliminating the loss of torque and preventing wear and generation of heat.

FIG. 7 shows a second embodiment of the present invention in which second pins 20a and 21a of cams 16a and 17a superposed to vanes 11a at the top position are positioned toward the inner ends of first pins 18a and 19a, the engaging recesses 26a, 26b, 26c, 27a, 27b and 27c formed in the side ends of the vanes 11a, 11b and 11c, respectively, being provided toward the inner ends of these side ends. Other structures are the same as those of the aforementioned first embodiment, and the description thereof will be omitted with reference numerals merely affixed.

In the above-described both embodiments, the locus of the end edges of the vanes 11a, 11b and 11c whose protrusion is defined is not always circular, and it is therefore desired that in designing the pump, dimensions and arrangements of parts are adjusted so that the locus is made close to a circle. However, conversely, the inner peripheral surface of the housing is not made to be circular but adjusted to the locus so that the end edges of the vanes 11a, 11b and 11c and the clearance in the inner peripheral surface of the housing are maintained to be equal to each other over the whole periphery.

Figure 8:
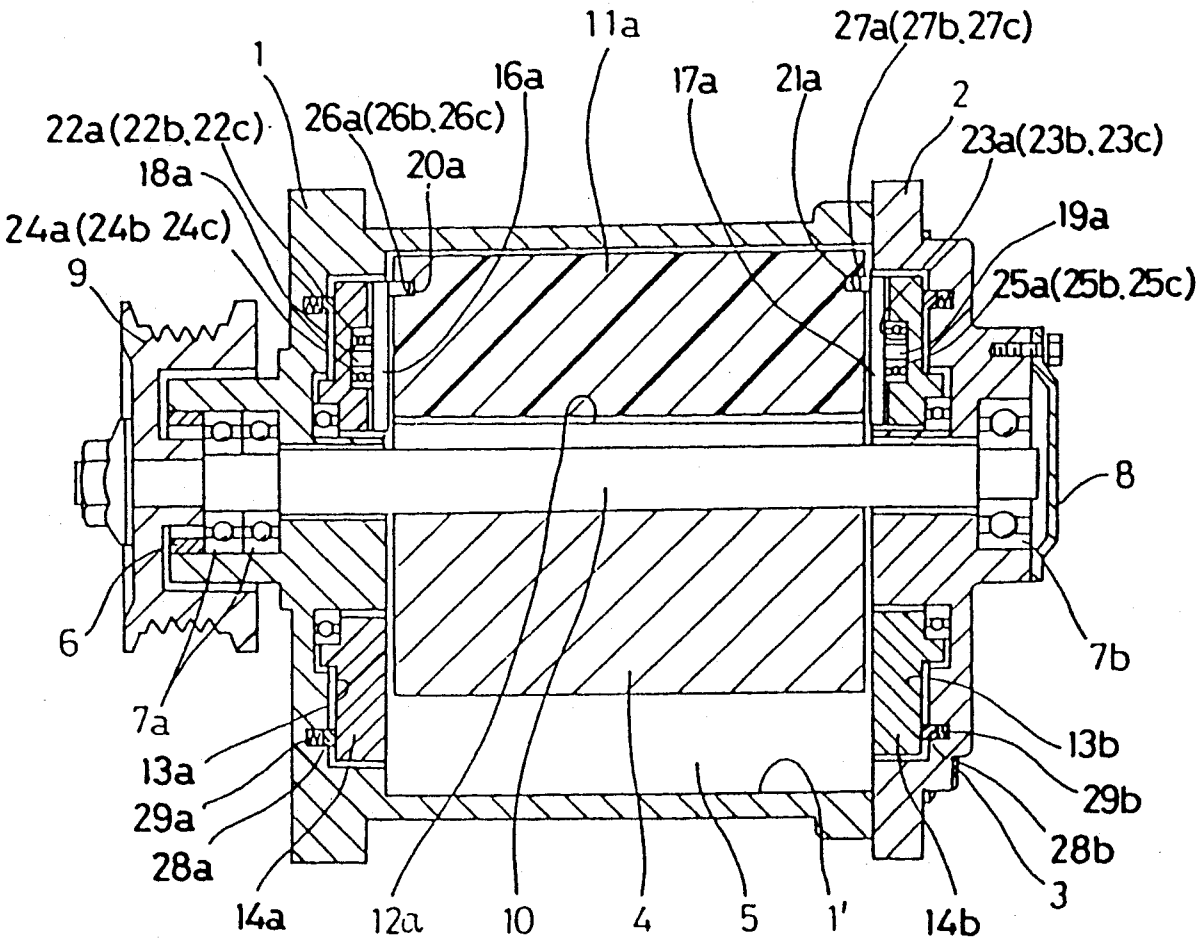
FIG. 8 is a sectional view of a vane pump according to yet another embodiment of the present invention.

Next, a third embodiment of the present invention will be described with reference to FIG. 8. The third embodiment is, in addition to the features of the pump according to the first embodiment, characterized in that backup rings 28a and 28b for restraining a deflection of the retainer plates are interposed between the retainer plates and the end walls of the housing. The vanes 11a, 11b and 11c are supported on the retainer plates 14a and 14b through the cams 16a, 16b, 16c, 17a, 17b and 17c. To provide the smooth projection and retraction of the vanes 11a, 11b and 11c, the retainer plates 14a and 14b must be firmly supported and smoothly rotated in order not to oscillate the retainer plates 14a and 14b. Practically, however, the ball bearings 15a and 15b oscillate in the thrust direction, and the retainer plates 14a and 14b oscillate due to the pressure distribution within the working space 5 into contact with the end walls of the housings 1 and 2, resulting in a deviation or an inclination of the vanes 11a, 11b and 11c. The present pump takes this into consideration beforehard and the backup rings 28a and 28b are interposed between the retainer plates 14a and 14b and the end walls of the housings 1 and 2 to prevent the oscillation of the retainer plates 14a and 14b. The backup rings 28a and 28b made of non-lubrication sliding material such as carbon and resin are fitted in annular grooves positioned partly of the annular recesses 13a and 13b, and the ends thereof are brought into contact with the back of the retainer plates 14a and 14b. In addition, a number of coil springs 29a and 29b are provided as needed to strengthen the supporting force, thus preventing the oscillation of the retainer plates 14a and 14b to prevent the retainer plates 14a and 14b from contacting the end wall of the housing to indirectly secure the smooth operation of the vanes 11a, 11b and 11c.

When a dynamic pressure bearing such as a spiral grooves, a herringbone groove, etc. is provided in the contact surface between the retainer plates 14a, 14b and the backup rings 28a, 28b, the sliding resistance may be reduced to make the rotation of the retainer plates 14a and 14b smooth.

Figure 9:
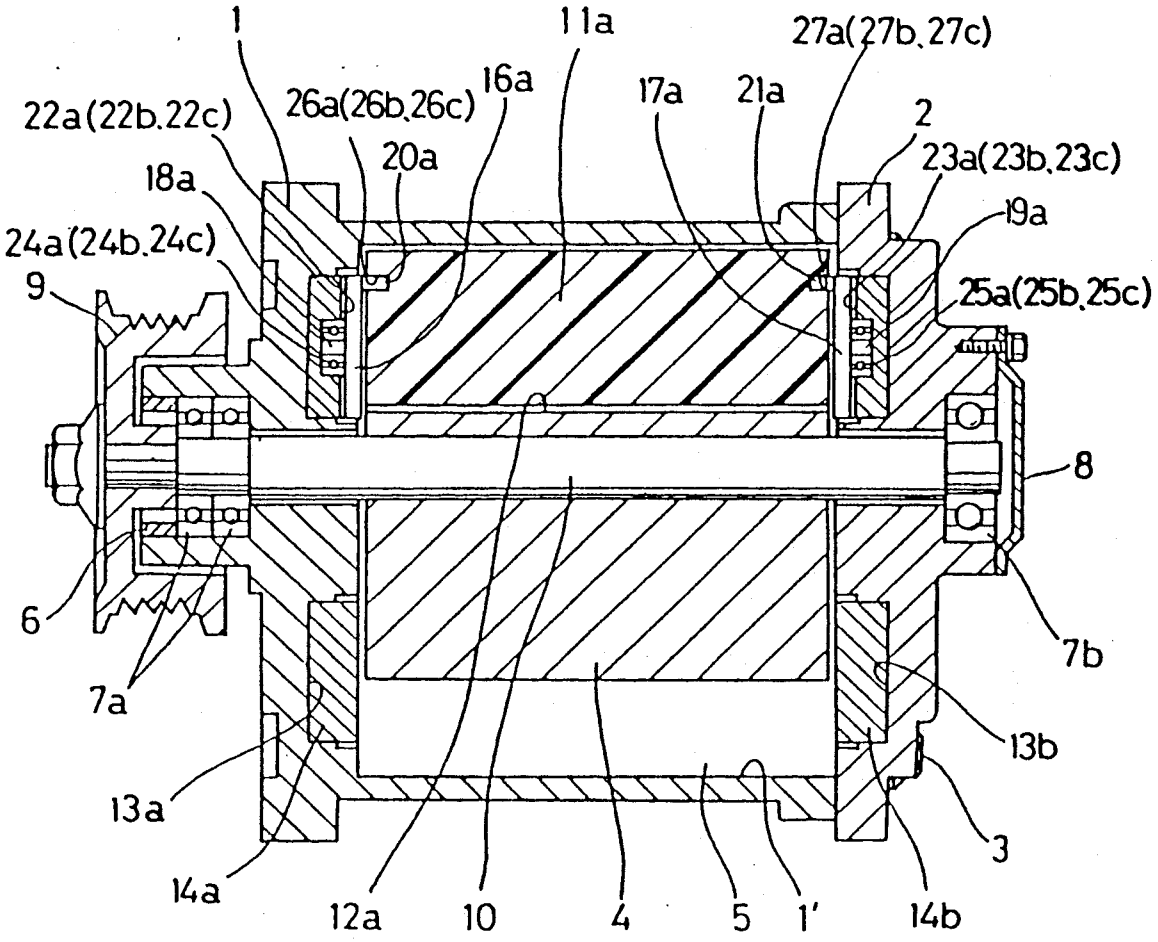
FIG. 9 is a sectional view of a vane pump according to still another embodiment of the present invention.
Figure 10:
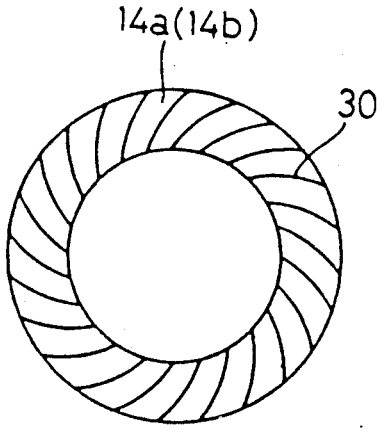
FIG. 10 is a front view of a retainer plate.
Figure 11:
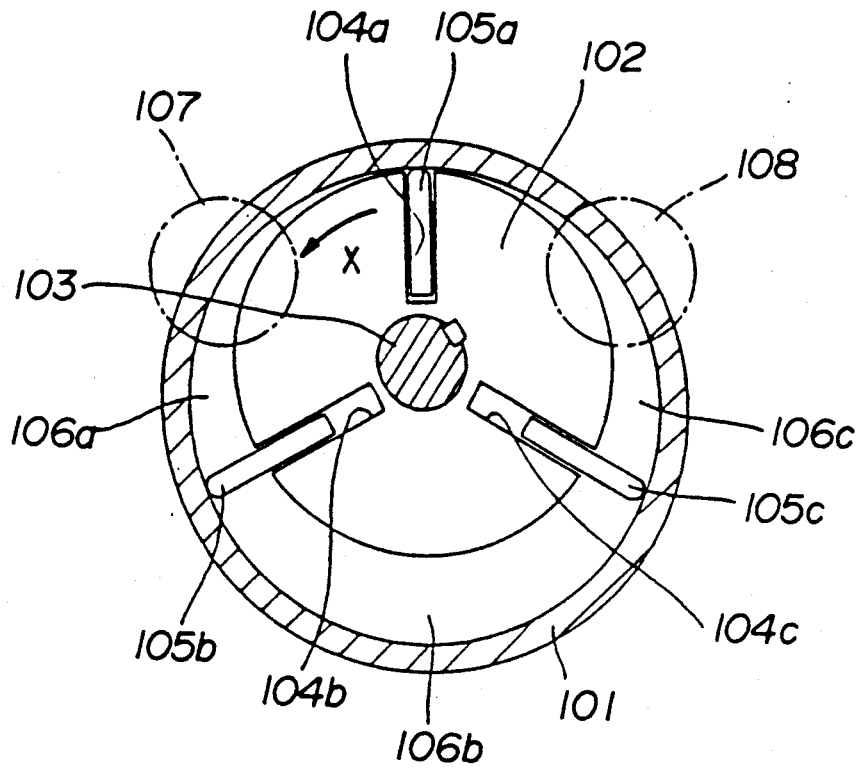
FIG. 11 PRIOR ART
FIG. 11 is a sectional view showing one example of a vane pump according to the prior art.

Next, a sixth embodiment of the present invention will be described hereinafter with reference to FIG. 9. According to the pump of this embodiment, while in the pump according to the first embodiment the retainer plates 14a and 14b are supported by the bearings 15a and 15b, this embodiment eliminates the need of the bearings 15a and 15b, and the retainer plates 14a and 14b are supported directly on the housings 1 and 2 and a dynamic pressure bearing mechanism is provided on the end or peripheral surface of the retainer plates 14a and 14b to reduce the number of parts, which constitutes the feature of this embodiment. This dynamic pressure bearing mechanism is composed of a groove capable of producing dynamic pressure such as a spiral groove, a Rayleigh step groove, a herringbone groove, etc. formed on the end surfaces or peripheral surfaces of the retainer plates 14a and 14b, or a recess or a combination of groove and recess to minimize the sliding resistance resulting from rotation of the retainer plates 14a and 14b. FIG. 10 shows, as one example of this dynamic pressure bearing mechanism, a spiral groove 30 provided in the outer end surface of the retainer plates 14a and 14b.

While we have described the preferred embodiment of the present invention, it will be obvious that various other modifications can be made without departing from the principle of the present invention. Accordingly, it is desired that all the modifications that may substantially obtain the effect of the present invention through the use of the structure substantially identical with or corresponding to the present invention are included in the scope of the present invention.

This application incorporates herein the disclosures of U.S. Ser. No. 075,006, filed July 17, 1987; U.S. Ser. No. 110,919 filed Oct. 21, 1987; U.S. Ser. No. 113,568 filed Oct. 26, 1987; and U.S. Ser. No. 115,677 filed Oct. 30, 1987.

What we claim is:

1. A rotary machine comprising a housing means having a rotor chamber, said rotor chamber having an inner peripheral surface, a rotor means rotatably mounted in said rotor chamber, said inner peripheral surface having a central axis which is eccentrically disposed relative to the axis of rotation of said rotor means, said rotor means having a plurality of generally radially disposed vane slots, a plurality of vane means slidably mounted in said vane slots and operable to define variable volume chambers as said rotor means rotates and said vane means move generally radially in and out of said vane slots, said housing means having annular ring means rotatable coaxial with said peripheral surface of said rotor chamber, and rotatable cam means operatively connected between said ring means and said vane means such that upon rotation of said rotor means, said cam means is operable to rotatably drive said ring means and to control the in and out radial movement of said vane means in said vane slots to preclude sliding contact between said vane means and said inner peripheral surface of said housing means, said cam means comprising a disk means having one part rotatably connected to said ring means and another part rotatably connected to said vane means, said other part being eccentrically disposed relative to said first part.

2. A rotary machine according to claim 1 wherein said disk means has a central axis of rotation, said one part of said disk means having an axis of rotation coincident with said central axis of rotation of said disk means.

3. A rotary machine comprising a housing means having a rotor chamber, said rotor chamber having an inner peripheral surface, a rotor means rotatably mounted in said rotor chamber, said inner peripheral surface having a central axis which is eccentrically disposed relative to the axis of rotation of said rotor means, said rotor means having a plurality of generally radially disposed vane slots, a plurality of vane means slidably mounted in said vane slots and operable to define variable volume chambers as said rotor means rotates and said vane means move generally radially in and out of said vane slots, said housing means having annular ring means rotatable coaxial with said peripheral surface of said rotor chamber, and rotatable cam means operatively connected between said ring means and said vane means such that upon rotation of said rotor means, said cam means is operable to rotatably drive said ring means and to control the in and out radial movement of said vane means in said vane slots to preclude sliding contact between said vane means and said inner peripheral surface of said housing means, said cam means comprising disk means and cam bearing means mounted on said ring means for rotatably supporting said disk means on said ring means, said cam bearing means rotating about a first axis, pin means extending from said disk means, said vane means rotatably mounting said pin means, said pin means having a longitudinal axis spaced from the axis of rotation of said cam bearing means.

4. A rotary machine comprising a housing means having a rotor chamber, said rotor chamber having an inner peripheral surface, a rotor means rotatably mounted in said rotor chamber, said inner peripheral surface having a central axis which is eccentrically disposed relative to the axis of rotation of said rotor means, said rotor means having a plurality of generally radially disposed vane slots, a plurality of vane means slidably mounted in said vane slots and operable to define variable volume chambers as said rotor means rotates and said vane means move generally radially in and out of said vane slots, said housing means having annular ring means rotatable coaxial with said peripheral surface of said rotor chamber, and rotatable cam means operatively connected between said ring means and said vane means such that upon rotation of said rotor means, said cam means is operable to rotatably drive said ring means and to control the in and out radial movement of said vane means in said vane slots to preclude sliding contact between said vane means and said inner peripheral surface of said housing means, said ring means having end walls perpendicular to the axis of said rotor means, said end walls having recesses which receive said cam means.

5. A rotary machine comprising a housing means having a rotor chamber, said rotor chamber having an inner peripheral surface, a rotor means rotatably mounted in said rotor chamber, said inner peripheral surface having a central axis which is eccentrically disposed relative to the axis of rotation of said rotor means, said rotor means having a plurality of generally radially disposed vane slots, a plurality of vane means slidably mounted in said vane slots and operable to define variable volume chambers as said rotor means rotates and said vane means move generally radially in and out of said vane slots, said housing means having annular ring means roatatable coaxial with said peripheral surface of said rotor chamber, and rotatable cam means operatively connected between said ring means and said vane means such that upon rotation of said rotor means, said cam means is operable to rotatably drive said ring means and to control the in and out radial movement of said vane means in said vane slots to preclude sliding contact between said vane means and said inner peripheral surface of said housing means, said rotatable cam means comprising rotary elements rotatably mounted on said ring means for rotation relative to said ring means about cam axes spaced from the axis of rotation of said rotor means, said rotary elements having a rotary connection means spaced from said cam axes, said rotary connecting means being rotatably connected to said vane means.

6. A rotary machine according to claim 5 wherein said vane means have an outer radial end and an inner radial end, said vane means having vane parts to which said rotary connecting means are rotatably connected, said vane parts being closer to said outer radial end of said vane means than to said inner radial end of said vane means.

7. A rotary machine according to claim 5 wherein said vane means have an outer radial end and an inner radial end, said vane means having vane parts to which said rotary connecting means are rotatably connected, said vane parts being further from said outer radial end of said vane means than from said inner radial end of said vane means.

8. A vane pump comprising a housing means having a rotor chamber, said rotor chamber having an inner peripheral surface, a rotor means rotatably mounted in said rotor chamber, said inner peripheral surface having a central axis which is eccentrically disposed relative to the axis of rotation of said rotor means, said rotor means having a plurality of geneally radially disposed vane slots, a plurality of vane means slidably mounted in said vane slots and operable to define variable volume chambers for effecting a pumping action as said rotor means rotates and said vane means move generally radially in and out of said vane slots, said housing means having annular ring means rotatable coaxial with said peripheral surface of said rotor chamber, and rotatable can means disposed between said ring means and said vane means, said cam means comprising rotatable disk means rotatable about axes spaced from the axis of rotation of said rotor means and spaced from the axis of said rotor chamber, said rotatable cam means being operable to effect said radial in and out movement of said vane means as said rotor means rotates, said rotatable disk means comprising first and second opposed surfaces each having a central portion and a peripheral portion, said cam means comprises first pin means provided on the central portion of said first surface of said rotatable disk means and cam bearing means receiving said first pin means, said ring means comprises recess means receiving said cam bearing means, said cam means for comprises second pin means provided on the peripheral portion of said second surface of said rotatable disk means, said vane having longitudinal end faces and recesses in said longitudinal end faces receiving said second pin means.

9. A vane pump according to claim 8, wherein the longitudinal end faces of said vane means comprise an inner portion and a peripheral portion, and said recesses of said vane means are provided at said peripheral portion of said longitudinal end faces.

10. A vane pump according to claim 8, wherein the longitudinal end faces of said vane means comprise an inner portion and a peripheral portion, and said recesses of said vane means are provided at said inner portion of said longitudinal end faces.

* * * * *